United States Patent [19]

Anderson et al.

[11] Patent Number: 4,780,015

[45] Date of Patent: Oct. 25, 1988

[54] IMPACT DETECTING PLATEN FOR A HIGH SPEED IMPACT LINE PRINTER

[75] Inventors: Lawrence L. Anderson, Vestal; Edward F. Helinski, Johnson City; Johann H. Meier; Jack L. Zable, both of Vestal, all of N.Y.

[73] Assignee: International Business Machines Corporation, Armonk, N.Y.

[21] Appl. No.: 925,591

[22] Filed: Oct. 31, 1986

[51] Int. Cl.[4] ..... B41J 11/08

[52] U.S. Cl. ..... 400/662; 101/93.14; 400/146; 400/703

[58] Field of Search ..... 101/93.03, 93.13, 93.14; 400/139, 146, 147, 148, 157.3, 166, 648, 656, 662, 703, 704; 73/11

[56] References Cited

FOREIGN PATENT DOCUMENTS 138671 8/1983 Japan ..... 400/146

OTHER PUBLICATIONS

"Print Hammer Flight Time Transducer", G. F. Pennell et al., *IBM Tech. Disc. Bull.;* vol. 22, No. 8B, p. 3673; Jan. 1980.

"Platen with Imbedded Transducers . . . ", W. T. Chen et al., *IBM Tech. Disc. Bull.;* vol. 24, No. 10, pp. 5084–5085; Mar. 1982.

"Multi-Function Impact Detector for Impact Printers"; E. Hindermeyer; *IBM Tech. Disc. Bull.; vol. 27, No. 6, p. 3345; Nov. 1984.*

"Instrumented Printer Platen with Feedback Control"; Anonymous; *IBM Tech. Bull.;* vol. 28, No. 4, pp. 1678–1680.

"Piezoelectric Transducer for Determining the Impact Times of Print Hammers"; Anonymous; *IBM Tech. Disc. Bull.;* vol. 29, No. 3, p. 1152; Aug. 1986.

*Primary Examiner*—David A. Wiecking

*Attorney, Agent, or Firm*—John S. Gasper

[57] ABSTRACT

A platen assembly for an impact printer comprises the combination of an impact transducer between the backup plate and the type band of a printer and an impact isolator interposed between the transducer and the type band. The transducer comprises a strip of force sensitive material. The strip extends over a plurality of print positions. Electrode means in contact with the surfaces of the force sensitive material form discrete impact zones aligned with the print hammers. One of the electrode means is a continuous conductive strip on one side of the force sensitive strip. Plural conductive pads on the other side of the strip form the discrete impact zones. The continuous conductive strip is preferably on the side facing the type band and serves as the ground connection. The impact isolation means comprises plural force elements between the type band and the transducer element and preferably is part of a comb which can be conductive and provides stiffening to the force sensitive strip. The transducer element can be a foil using PVF2 with etched conductive patterns forming the electrodes.

9 Claims, 7 Drawing Sheets

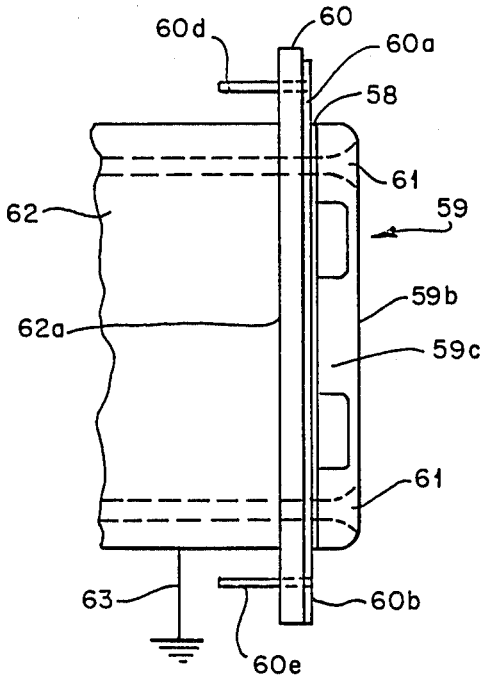
FIG. 11
FIG. 12
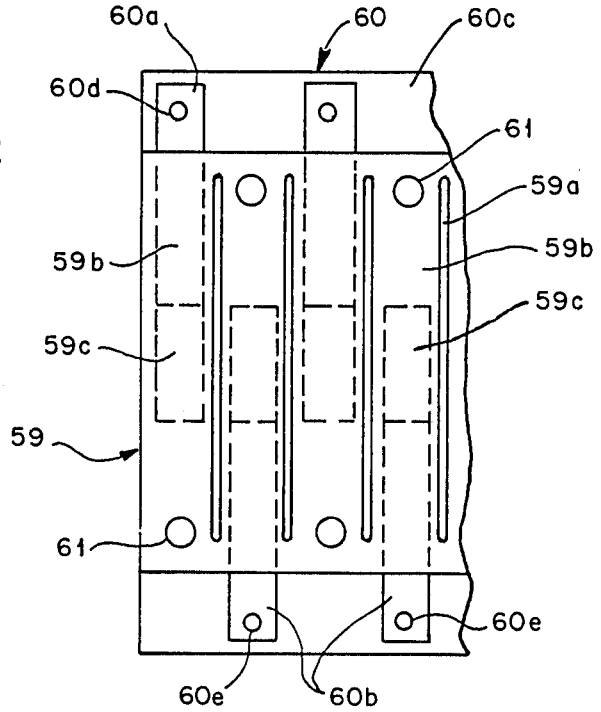

IMPACT DETECTING PLATEN FOR A HIGH SPEED IMPACT LINE PRINTER

FIELD OF THE INVENTION

This invention relates to impact printers and particularly to a platen useful for measuring or testing the flight time or other parameters of print hammers in an on-the-fly impact line printer.

BACKGROUND OF THE INVENTION

In impact line printers, a plurality of print hammers are arranged in a row parallel with a continuous type carrier such as a flexible type belt or band with engraved characters. The carrier is supported by a pair of spaced drive rolls or pulleys and has a straight section opposite the row of hammers. A platen behind the straight section provides support in opposition to impact forces from the hammers. A control system selectively operates the hammers in synchronism with the movement of the type. The operating control depends on the flight times of the individual hammers. The flight times will differ among hammers. In addition, the flight times are subject to variation over a period of use.

It has been a common practice to measure the average flight time of each hammer at the time of manufacture and installation. The flight times are remeasured periodically. Such remeasurement heretofore involved interruption of printing, the removal of the print medium and the replacement of the type carrier with a test bar. It has been proposed to place transducer devices behind the carrier or within the platens. Examples of this are seen in U. S. Pat. No. 3,872,788 and the IBM Technical Disclosure Bulletin of January 1980, p. 3673, Vol. 22, No. 8B; of Mar. 1982, pp. 5084–5085, Vol. 24, No. 10; and of Nov. 1984, p. 3345, Vol. 27, No. 6. However, in such proposed arrangements, accuracy is print media limited and durability is too short.

SUMMARY OF THE INVENTION

In accordance with this invention, a platen is provided which enables hammer flight time, contact time or force amplitude testing and measurement to be accomplished during normal printing operations. It is not necessary to remove the print medium which can vary as to the number of layers of paper.

Basically, the invention comprises the combination of an impact transducer between the backup plate and the type band of a printer and an impact isolator interposed between the transducer and the type band. The transducer comprises a strip of force sensitive material. The strip extends over a plurality of print positions. Electrode means in contact with the surfaces of the force sensitive material form discrete impact zones aligned with the print hammers. One of the electrodes is a continuous conductive strip on one side of the force sensitive material. Plural conductive pads on the other side form the discrete impact zones. The continuous conductive strip is preferably on the side facing the type band and serves as the ground connection. The impact isolator comprises plural force transmitting elements between the type band and the transducer element and preferably is part of a comb which can be conductive and provides stiffening to the force sensitive material. The transducer element is preferably a foil using polyvinyladenefluoride (PVF2) as the force sensitive material.

In one embodiment, the force elements of the impact isolator are individual force pads and are bonded to the continuous electrode. In a second embodiment, the electrodes comprise two sets of individual aligned contacts on opposite surfaces of the force sensitive material and the force elements are individual fingers of a comb bonded to one set of contacts. The comb is made of conductive material in order to provide a suitable external ground connection to the one set of contacts. In a third embodiment, the fingers of the comb are flexure members and the force elements are pads carried on one end of the flexure members and are maintained in contact with the continuous electrode. In a fourth embodiment, the force sensitive material is not metallized but is clamped between a printed circuit board and a conductive plate. The electrodes for defining the impact zones are formed on the circuit board and take the form of individual conductive strips held in contact with one surface of the force sensitive material. A conductive plate, pressed against the opposite surface has flexure elements with force pads aligned with the conductive strips on the printed circuit board. In this embodiment, the conductive plate forms both the mechanical isolator and the continuous electrode.

In all embodiments, the printed circuit board, the impact transducer element and the impact isolator are bonded together as a compact transducer assembly which is, in turn, bonded to the backup surface of the platen. In this way, a platen assembly is provided which is capable of detecting hammer impacts through the print medium, over a range of thicknesses, and also provides for signal line connection to external flight time measurement controls of the printer. Other advantages will become apparent from the detailed description of the invention which follows.

BRIEF DESCRIPTION OF THE FIGS.

Figure 1:
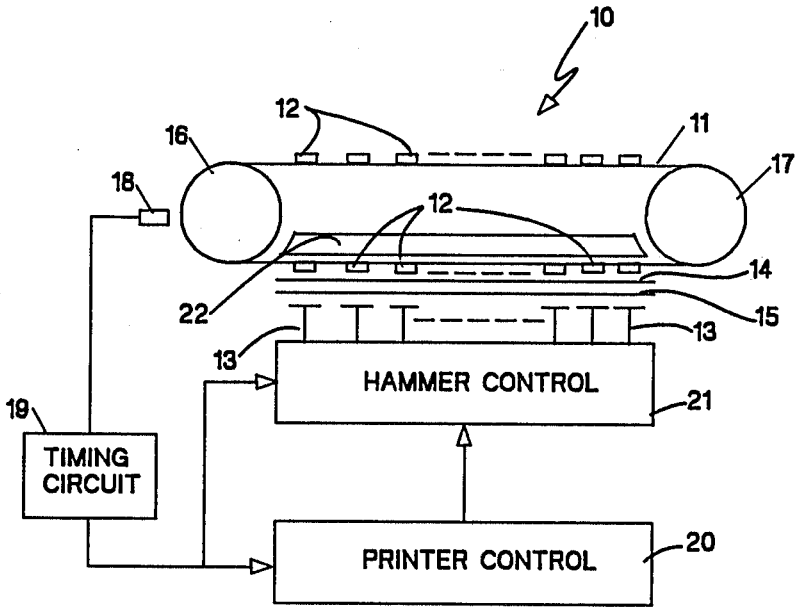
FIG. 1 is a schematic of a band printer showing the basic arrangement of the mechanism in which the invention is incorporated.
Figure 2:
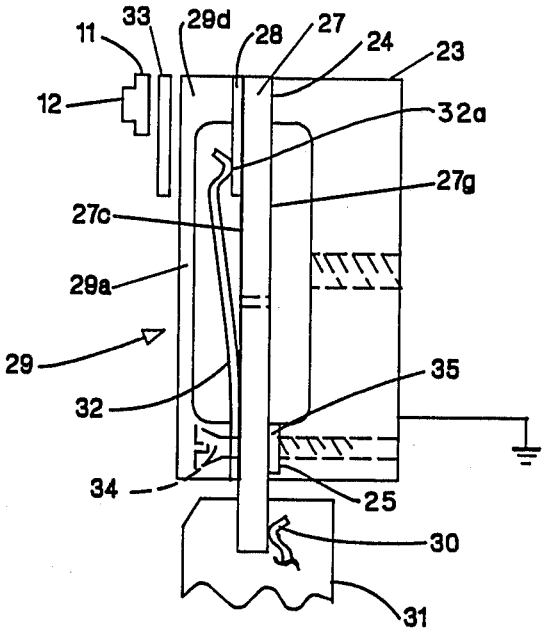
FIG. 2 is an end view of one embodiment of a segmented platen assembly.
Figure 5:
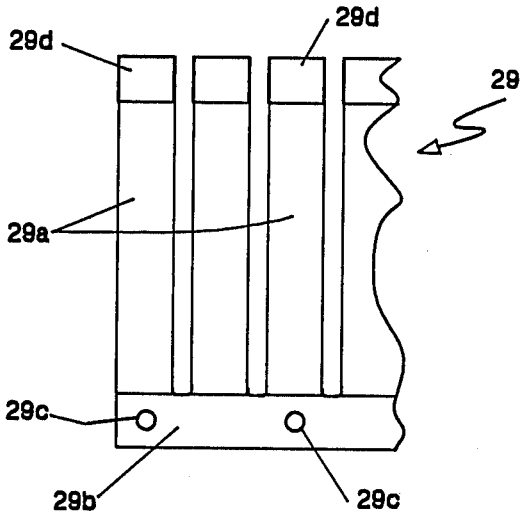
Figure 3A:
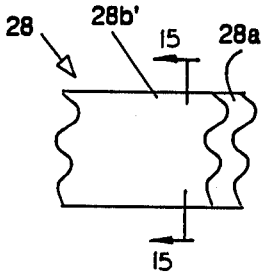
Figure 3B:
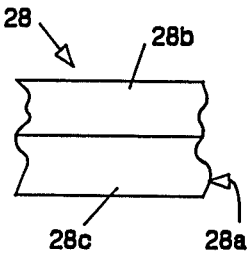
Figure 3C:
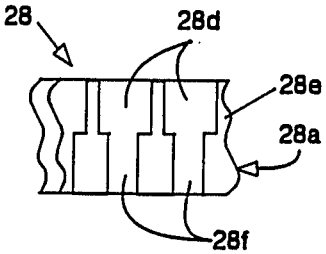
Figure 4:
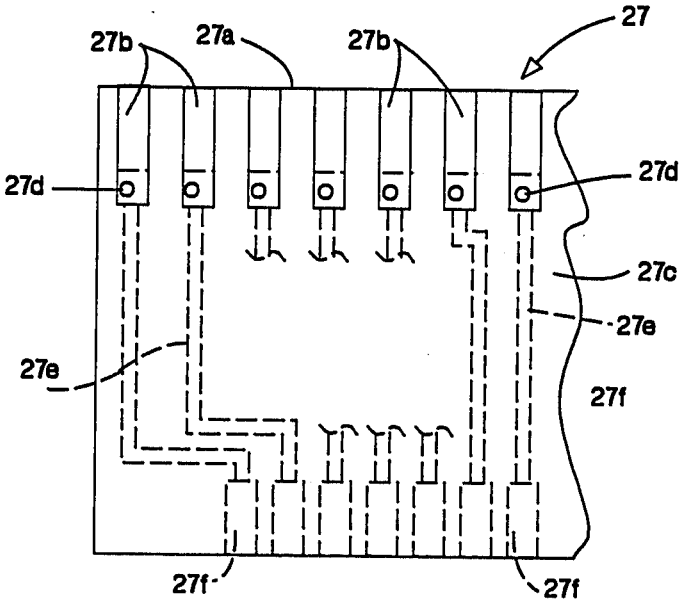
Figure 6:
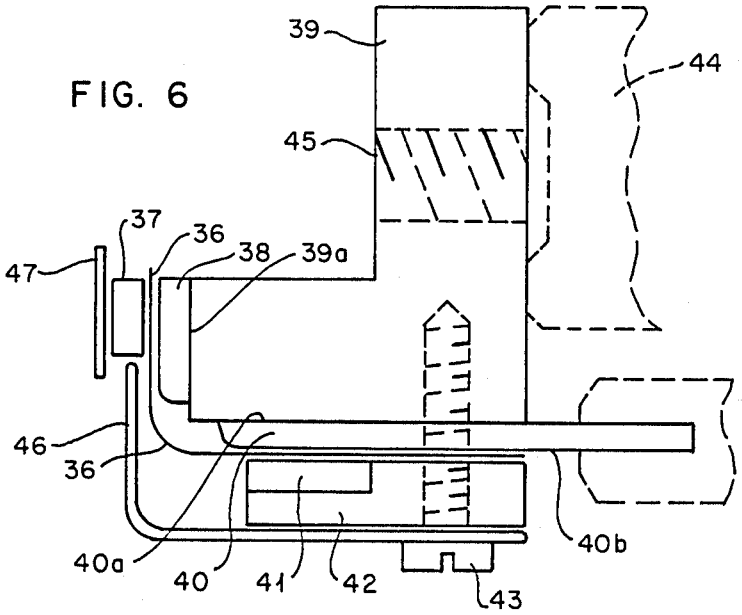
Figure 7:
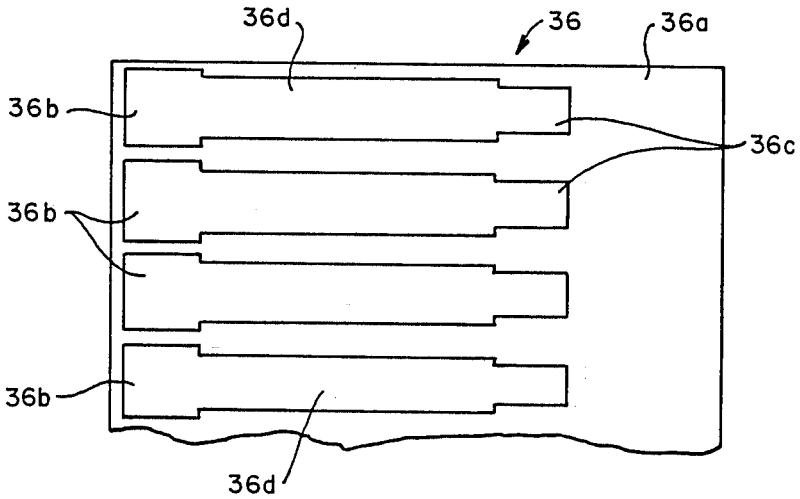
Figure 8:
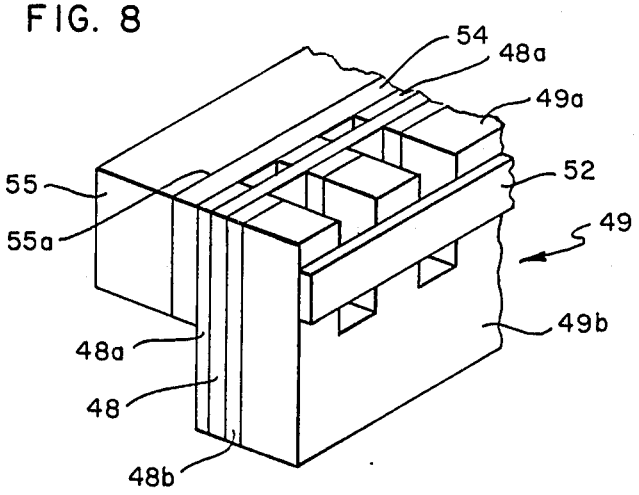
Figure 9:
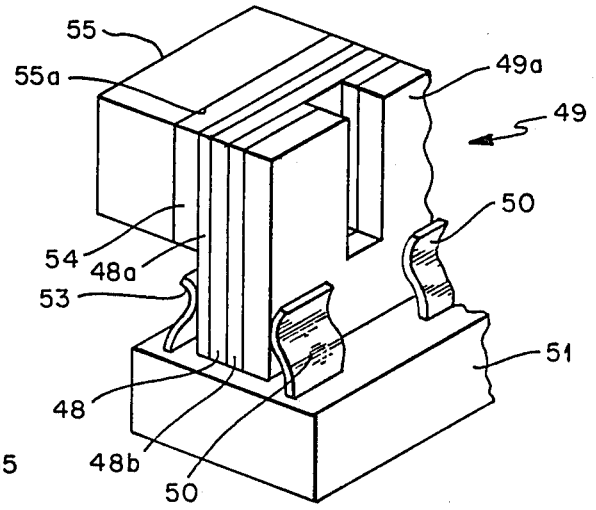
Figure 10:
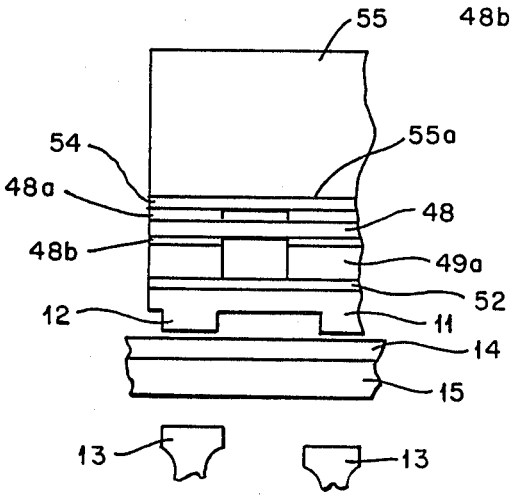

FIGS. 3*a*, 3*b* and 3*c* show conductive patterns on the foil sensor of the platen assembly of FIG. 2;

FIG. 4 is an elevation view showing the conductor pattern on the circuit board of the platen assembly of FIG. 1;

FIG. 5 is a front elevation of the mechanical isolator element of FIG. 2;

FIG. 6 is a side elevation view of a second embodiment of the platen constructed in accordance with the invention;

FIG. 7 is a plan view of the conductive pattern on the back side of the transducer element of FIG. 6;

FIGS. 8 and 9 are three dimensional views of a third embodiment of the invention;

FIG. 10 is a top plan view of the embodiment shown in FIGS. 8 and 9;

FIG. 11 is a side elevation view of a platen assembly showing a fourth embodiment of the invention;

FIG. 12 is a front view of the platen assembly of FIG. 11.

Figure 13:
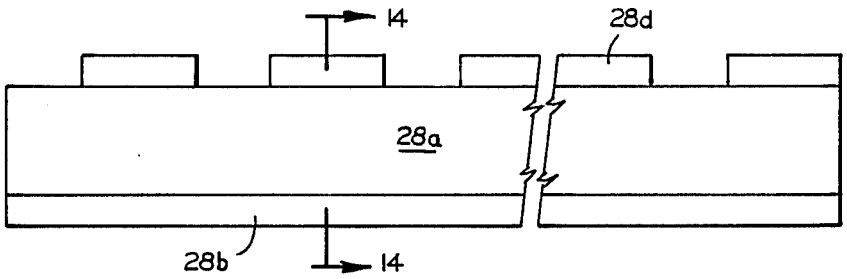

FIG. 13 is a top view of the transducer element in FIG. 3*b;*

Figure 14:
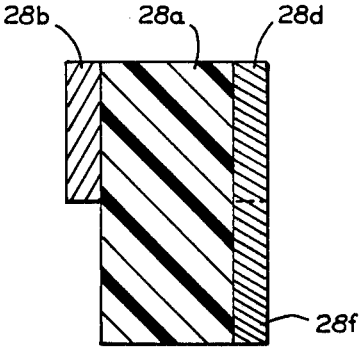
Figure 15:
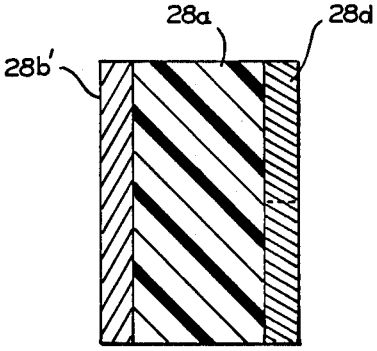

FIG. 14 is a section of the transducer element taken along line 14—14 in FIG. 13;

FIG. 15 is a section of the transducer element in FIG. 3*a* taken along line 15—15.

DESCRIPTION OF THE PREFERRED EMBODIMENTS

The printer mechanism 10 shown in FIG. 1 comprises a continuous type band 11 having engraved type characters 12 facing a row of uniformly spaced print hammers 13. A print medium comprising ink ribbon 14 and paper 15 are interposed between the type characters 12 and the print hammers 13. Ribbon 14 may be the bed sheet type fed between a pair of ribbon rolls (not shown). Paper 15 may be a continuous web fed by tractor mechanisms operated by a suitable motor (not shown). Type band 11 is rotatably supported on spaced drive pulleys 16 and 17. A motor (not shown) is connected to one of the pulleys and operates to revolve the type band in a fixed direction and at a constant speed throughout the printing operation. The characters 12 are formed entirely around the type band and are uniformly spaced. Band 11 also has engraved timing marks (not shown) which are sensed by a transducer 18 which with a timing circuit 19 generates timing pulses used by printer control 20 to operate the hammer control 21 for selectively firing hammers 13 in timed relation with the motion of the characters 12. Print hammers 13 may be of any type but in general are electromagnetic and include a hammer element which impacts the paper 15 and ink ribbon 14 against characters 12 of band 11.

Located behind the straight section of type band 11 and at least coextensive with the row of print hammers is platen 22. The purpose of platen 22 is to provide back up support to the flexible band so as to limit the displacement of the type band when the print medium is impacted by the hammers. Platen 22 may take various forms but generally includes a back plate or block fixedly attached to a machine frame (not shown). In accordance with this invention, platen 22 is constructed so that impacts of the individual hammers 13 can be electrically detected and in combination with control signals for operating hammers 13, the flight time of the individual hammers can be determined in the course of the printing operation. To facilitate the understanding of the invention, well known details of platen mounting structure are omitted.

In the embodiment of FIG. 2, the platen assembly comprises plate member 23 having upper and lower mounting surfaces 24 and 25. When attached to the machine frame by fastening means such as bolts threaded into hole 26, mounting surface 24 is aligned with and serves as the backup surface for type band 11 in FIG. 1. Impact transducer means is mounted between platen member 23 and the type band and takes the form of an impact transducer assembly of circuit board 27, transducer element 28 and impact isolator 29. In one form of the invention, there are a plurality of transducer assemblies across platen 22, there being a transducer assembly for each of a plurality of horizontal sections or segments of platen 22 although plate member 23 with surfaces 24 and 25 is a single piece. Alternatively a single transducer assembly may be coextensive with platen 22.

As seen in FIGS. 3*a–c*, and 13–15 transducer element 28 comprises a force sensitive strip 28*a* sandwiched between a continuous conductive strip 28*b* on its front surface 28*c* facing the type band, and a plurality of individual conductive pickup pads 28*d* on its back surface 28*e*. Conductive strip 28*b* is coextensive with the length of strip 28*a* which extends over a plurality of the print hammer positions. Pickup pads 28*d* as seen in FIG. 3*c* are uniformly spaced and align with individual print hammer positions covered by the strip and coact with conductive strip 28*b* to form a plurality of impact sense zones. Strip 28*a* can be various materials but preferably is fabricated from a foil made of piezoelectric material, such as PVF2, coated with metal such as aluminum. Conductive strip 28*b* as shown in FIG. 3*b* and the pickup pads 28*d* can be formed by etching or some other subtractive process. Alternatively, conductive strip 28*b* and pickup pads 28*d* may be formed on strip 28*a* by an additive process such as vapor deposition or silk screening. Conductive strip 28*b'* as seen in FIG. 3*a*completely covers front surface of strip 28*a* and therefore requires no etching. Pickup pads 28*d* are nearly as wide as the spacing of hammers 11 and have somewhat narrower contact pads 28*f* for connection with corresponding conductive pads on circuit board 27.

As shown in FIG. 4, circuit board 27 comprises an insulator board 27*a* with plural electrical conductive contact pads 27*b* formed on front surface 27*c* in a pattern corresponding with the contact pads 28*f* of pickup pads 28*d* on transducer element 28. Electrical connection to contact pads 27*b* is provided by through connections 27*d* and conductors 27*e*to terminal pads 27*f* on back surface 27*g*. Insulator board 27*a* may be made from epoxy glass. Contact pads 27*b*, conductors 27*e* and terminal pads 27*f* are formed by etching of metal layers, such as copper, and the through connections 27*d* may be made by plating holes in board 27*a* in accordance with well known printed circuit techniques and processes. Contact pads 27*b*, conductors 27*e* and terminal pads 27*f* form the signal lines through which impact signals generated by transducer element 28 are transmitted to external control circuitry through contacts 30 of circuit board connector 31 shown in FIG. 2.

As shown in FIGS. 2 and 5, the impact isolator 29 comprises a plurality of resilient fingers 29*a* extending from cross bar 29*b* having attachment holes 29*c*. The upper end of fingers 29*a* terminate in individual force pads 29*d* which bear on the continuous electrode 28*b* of transducer element 28. The width of fingers 29*a* and pads 29*d* is slightly less than the hammer spacing. The height of the force pads 29*d* corresponds to the height of the continuous electrode 28*b*. Impact isolator 29 may be made of steel in which case it is used as the ground connection for continuous electrode strip 28*b*. Alternatively, impact isolator 29 may be non-metallic. In that case, the higher continuous strip 28*b'* is used on transducer material 28*a* and the height of the force pads 29*d* is less than the height of the continuous strip 28*b'*. With that arrangement, electrical ground connection is made with one or more spring fingers 32 of a conductive comb with end pads 32*a* bearing on the lower portion of the wider continuous conductive strip 28*b'*. Non-conductive wear strip 33 is interposed between the force pads 29*d* of impact isolator 29 and the type band 11.

In assembly, transducer strip 28 and board 27 are carefully lined up with the contact tabs 28*f* and contact pads 27*b* in alignment. The back side of transducer element 28 is cemented with a no-conductive adhesive to board 27. Pressure is applied to the package until the contact pads 28*f* and the pickup tabs 27*b* are in surface contact with each other and the non-conductive adhesive is squeezed into the spaces between the tabs. The use of non-conductive adhesive prevents electrical shorting or connection between adjacent tabs 28*d* and 27*b*. The front side of transducer element 28 is then cemented to force pads 29d on mechanical isolator 29 with either conductive or nonconductive adhesive. The transducer assembly is then handled as one piece and assembled to platen member 23 by means of metallic screws 34. Non-conductive strip 35 serves to isolate conductors 27e from mounting surface 25 of platen member 23. Metallic screws 34 form the ground connection of impact isolator 29 or conductive fingers 32 with plate member 23 of the machine frame. The entire assembly is then placed in a fixture and appropriate pressure is applied between force pads 29d and backup plate 23 for curing of the non-conductive adhesive The entire platen assembly is then mounted on the platen support (not shown) by means of threaded hole 26.

In the embodiment of FIGS. 6 and 7, the transducer element comprises foil 36 with a force sensitive layer 36a with a conductive land pattern etched on the back side as shown in FIG. 7. Pickup pads 36b are nearly as wide as the hammer spacing with contact pads 36c being somewhat narrower and conductors 36d of intermediate width. The front side of foil 36 is not etched. Impact pads 37 are cemented to the conductive layer on the front surface of foil 36 in alignment with pickup pads 36b. The back surface of foil 36 is cemented to insulator 38. Non-conductive adhesive is used to provide electrical isolation. Insulator 38 in turn is cemented to backup surface 39a of back plate 39. Care must be taken in this assembly to assure proper location of impact pads 37 with respect to backup surface 39a.

Circuit board 40 has continuous plating on its top surface 40a. A land pattern matching the conductors 36c on foil 36 is formed on the bottom surface 40b. Foam rubber pad 41 is compressed by metallic bar 42 to exert pressure on foil 36 and board 40 to assure proper contact between the respective land patterns on the back side of foil 36 and on the bottom side of board 40. Behind rubber pad 41, metallic bar 42 makes contact with the conductive layer on the front surface of foil 36 which it compresses against the bottom surface of board 40. Bar 42, foil 36 and board 40 are located and clamped by metallic grounding screws 43 threaded into back plate 39 thereby grounding the metallic front surface of foil 36. The matching land patterns on the facing surfaces of foil 36 and board 40 end short of the location of screws 43 so that screws 43 are electrically isolated from the land patterns on foil 36 and board 40. Back plate 40 is mounted on platen support 44 by screws (not shown) engaging tapped holes 45. Metallic shield 46 is optional and serves to protect foil 36 against accidental damage. If used, it clamps under screws 43 and preferably does not touch foil 36. 47 is a movable or replaceable plastic strip which protects impact pads 37 against contact with print band 11. This embodiment does involve a finite length of conductor resulting from the etched pattern on the foil. This conductor may have a fairly high resistance. To eliminate the effect of this resistance, it is recommended that the the impact signals be fed directly into a high input-impedance operational amplifier. Very accurate location and cementing of the individual impact pads 37 on foil 36 is required. A magnetic jig is suggested for the purpose.

In the embodiment of FIGS. 8, 9 and 10, the transducer element is a PVF2 strip 48 with individual conductive elements 48a and 48b etched on both sides and bonded to a conductive stiffener 49 comprising fingers 49a extending from a cross bar 49b. The conductive elements 48a and *b* are arranged along strip 48 to coincide with each print hammer. The conductive elements 48b are in intimate electrical contact and coincident with fingers 49a and are connected via connectors 50 to ground. Conductive elements 48a are connected to individual signal lines via connectors 53. A circuit card 51 containing both the ground and the individual signal lines and connectors 50 and 53 is plugged into the combination of stiffener 49 transducer element 48. Wear strip 52 over which the print band rides protects stiffener 49 from wearing. A layer of insulation, such as nylon strip 54, is bonded to the back side of conductive element, strip and stiffener combination. The combination is bonded to a backup surface 55a of platen member 55. FIG. 10 shows the overall combination in a printer. Thus there will be an individual impact signal detected each time a given hammer impacts the paper. This signal can be processed to obtain hammer flight time, contact time or force amplitude while the printer is operating. As such it can be used for diagnostic and flight time control and energy control purposes for each hammer in the printer.

In the embodiment of FIGS. 11 and 12, the transducer is a strip 58 of PVF2 material clamped between conductive plate 59 and circuit board 60 which in turn are clamped by metallic screws 61 to backup surface 62a of backup plate 62. Screws 61 are insulated from strip 58 and circuit board 60. Conductive plate 59 serves both as the ground connection and impact isolator for the assembly. Conductive strips 60a and 60b are etched on the front surface 60c of the circuit board 60. Strips 60a and *b* are interspersed from opposite edges of board 60 with a spacing equal to the spacing of the print hammers. Conductive pins 60d and 60e through board 60 provide means for connecting the strips 60a and *b* to external circuitry for utilizing the impact signals generated by force sensor strip 58. Metallic screws 61 pass through plate 59 and are threaded into backup plate 62 which has an electrical ground connection 63. Impact isolation is provided by machining slots 59a through plate 59 to form a plurality of flexure elements 59b which are aligned with the individual conductive strips 60a and *b* on board 58. As best seen in FIG. 11, the flexure elements 59b have impact force pads 59c which are in intimate contact with the individual conductive strips 60a and *b* and are aligned with individual print hammers.

Thus is can be seen from the foregoing description that a platen assembly means has been provided which allows hammer impacts to be detected while printing occurs. This eliminates the need for interrupting printing and replacing the type carrier with special impact sensing devices.

While the invention has been particularly shown and described with reference to specific embodiments thereof, it will be understood by those skilled in the art that the foregoing can be changed and can take other forms without departing from the spirit of the invention.

We claim:

1. An impact printer having a continous flexible type band having a straight section running parallel with a print line, a row of hammers along said straight section of said type band, said hammers being individually operable to impact a print medium against characters along said straight section of said type band, platen means for limiting displacement of said flexible type band resulting from impact of said print medium against said type characters, said platen means having a stationary impact surface positioned behind said straight section of said type band proximate the back surface of said type band, and means for detecting impacts of said print medium against said type band by each of said hammers comprising transducer means between said impact surface of said platen means and said back surface of said type band including a force transducer element having an impact surface spanning a plurality of said print hammers along said print line, said transducer element comprising a thin strip of force sensitive material spanning said plurality of print hammers for generating an electric signal when impacted by said type band and electrode means comprising a continuous electrode on one side of said strip and a plurality of individual electrodes on the opposite side of said strip and forming a plurality of discrete impacts zones in said transducer element, said impact zones being aligned with individual ones of said plurality of print hammers, and impact isolation means comprising a plurality of force pads between said back surface of said type band and said transducer element and aligned with individual ones of said print hammers and said electrode means forming said impact zones of said transducer element, said continuous electrode being on the side of said force sensitive strip facing said back surface of said type band and engaged by said plurality of force pads of said isolation means.

2. An impact printer in accordance with claim 1 wherein said strip of force sensitive material is a piezoelectric foil.

3. An impact printer in accordance with claim 2 wherein said strip of force sensitive material is PVF2.

4. An impact printer in accordance claim 1 wherein said force pads are adhesively bonded into engagement with said continuous electrode.

5. An impact printer in accordance with claim 1 wherein said impact isolation means comprises a comb member having a plurality of individual fingers extending from a cross bar, and said fingers terminate in said force pads which bear on said continuous electrode of said transducer element.

6. An impact printer in accordance with claim 5 wherein said comb member is a conductive comb forming a common ground connection through said force pads to said continuous electrode of said transducer element.

7. An impact printer in accordance with claim 1 wherein said continuous electrode is a ground electrode.

8. An impact printer in accordance with claim 1 wherein said electrode means forming said discrete impact zones comprises a first plurality of electrodes on a first side of said force sensitive material, a second plurality of electrodes on a second side of said force sensitive material and aligned with said first plurality of electrodes, and said impact isolation means comprises a conductive comb having individual impact finger elements in intimate contact with either said first or said second plurality of electrodes.

9. An impact printer in accordance with claim 1 wherein said transducer means comprises circuit board means having a plurality of conductive elements formed on a surface thereof, said conductive elements being spaced for alignment with individual print hammers, a strip of force sensitive material having a first surface overlaying said plurality of conductive elements on said surface of said circuit board means, and said impact isolation means comprises a conductive plate overlaying a second surface of said force sensitive material, said plate having a plurality of flexure elements with force pads in intimate contact with said second surface of said force sensitive material, said force pads being aligned with said conductive elements on said surface of said circuit board means and coactable therewith to form said impact zones.

* * * * *